US012471743B2

(12) United States Patent
Sandford

(10) Patent No.: US 12,471,743 B2
(45) Date of Patent: Nov. 18, 2025

(54) TISSUE BOX DISPENSING FEATURE

(71) Applicant: Peter E. Sandford, London (CA)

(72) Inventor: Peter E. Sandford, London (CA)

( * ) Notice: Subject to any disclaimer, the term of this patent is extended or adjusted under 35 U.S.C. 154(b) by 189 days.

(21) Appl. No.: 18/127,496

(22) Filed: Mar. 28, 2023

(65) Prior Publication Data

US 2023/0309761 A1 Oct. 5, 2023

Related U.S. Application Data

(60) Provisional application No. 63/326,113, filed on Mar. 31, 2022.

(51) Int. Cl.

| | |
|---|---|
| ***B65D 83/08*** | (2006.01) |
| ***A47K 10/42*** | (2006.01) |
| *A47K 10/32* | (2006.01) |

(52) U.S. Cl.
CPC ..... *A47K 10/421* (2013.01); *B65D 83/0805* (2013.01); *A47K 2010/3233* (2013.01)

(58) Field of Classification Search
CPC . A47K 10/421; B65D 83/0805; B65D 83/084
USPC ..... 221/33–63
See application file for complete search history.

(56) References Cited

U.S. PATENT DOCUMENTS

| | | | | |
|---|---|---|---|---|
| 3,955,711 A * | 5/1976 | Schroter | ..... | B65C 11/004 156/577 |
| 4,586,630 A * | 5/1986 | Loder | ..... | B65D 83/0805 221/63 |
| 6,817,484 B2 * | 11/2004 | Morin | ..... | B65D 83/0894 221/48 |

* cited by examiner

*Primary Examiner* — Gene O Crawford
*Assistant Examiner* — Ayodeji T Ojofeitimi
(74) *Attorney, Agent, or Firm* — Eduardo Krupnik

(57) ABSTRACT

A single piece tissue container free of a plastic film or paper dispensing window comprising a tissue dispensing portion on a top panel of the tissue container, the tissue dispensing portion comprising: (a) an outlet cut line having a wave shape form; (b) two opposite raised crease lines embossed on the top panel spaced on both left and right side of the outlet cut line, the two opposite raised crease lines being joined by curvilinear cut lines at each end of the two opposite raised crease lines; and (c) two outlet flaps, each outlet flap being defined between one of the two raised crease lines, the curvilinear cut lines and the outlet cut line, each of the two raised crease lines forming a smooth curve on an underside of the outlet flaps.

15 Claims, 8 Drawing Sheets

TISSUE BOX DISPENSING FEATURE

CROSS REFERENCE TO RELATED APPLICATIONS

This application claims the benefit under 35 U.S.C. 119(e) of U.S. Provisional Application No. 63/326,113, filed Mar. 31, 2022, the contents of which are hereby incorporated by reference into the present disclosure.

TECHNICAL FIELD

The present disclosure relates to the field of tissue boxes. More particularly, the present disclosure relates to a tissue carton from which approximately a half portion of a following tissue, followed by a leading tissue, can be drawn out through the dispensing outlet of the carton opening feature. More specifically, it relates to a tissue box having an intrinsic tissue box opening and dispensing feature having a curvilinear outlet.

BACKGROUND ART

FIGS. 1 and 2 are a perspective view of a conventional rectangular shape facial tissue carton. In general, tissue dispensing cartons or boxes are composed of four side wall panels, a full base or bottom panel and a top panel. In most cases, the underside of the top carton panel, has a sheet of transparent poly film, containing a narrow slot or slit opening. The poly film is longitudinally centered and bonded to the panel, directly below a perforated tear away access panel and centered under the top panel of the tissue carton. A stack of interleafed facial tissues is centered in the tissue carton. Access to facilitate retrieval of the top or first tissue takes place through removal of the perforated panel, which in turn provides access to and through the poly film, to select and withdraw the top tissue.

The following shortcomings are associated with conventional tissue cartons that implement the use of a transparent poly film for tissue dispensing features and prior art cartons: 1) The process for attaching the transparent film 5 (FIG. 1) to the underside of the top carton panel 3 (FIG. 1) involves significant material and production costs. 2) The slot or slit 6 (FIG. 1) in the transparent poly film stretches and weakens with use; thereby failing to consistently separate the interleafed tissues. At this point, the tissues lack sufficient support from the weakening poly film slot or slit 6 (FIG. 1), to vertically hold the tissue 2 (FIG. 2) in an erect standing position. 3) Transparent poly film must be manually removed from the tissue carton to overcome recycling issues.

WO97/39964 describes a tissue box without transparent film (see FIGS. 3A and 3B). However, WO97/39964 presents the following shortcomings: 1) utilizes depressed engraving lines 41 located on each of the left and right outlet panels. These depressed engraved lines are used to bend the panels 42 backwards to provide open access to the tissue stack. Back bending the depressed engraving lines 41 creates a sharp bend along the underside of the outlet panel 30, which impedes and restricts the outward movement of the tissues; 2) utilizes perforated tear out portions that create rough teeth shaped edges 42, 41 (FIG. 3A) and sharp corners 44 on the ends of the outlet panels, on which exiting tissues catch and tear; 3) utilizes intersecting corners 44 throughout the outlet design that create restrictive pinch points which the out flowing tissues flow into, gather, wedge and tear; and 4) utilizes the raw unfinished underside of carton panel 30, to slide exiting tissues over and through the outlet opening. The raw underside of outlet panel 42 (FIG. 3A) in combination with the sharp engraved fold line 41, creates friction that restricts and compromises tissue flow, separation and travel from the tissue stack through the outlet panels 42.

What is needed is a tissue box that overcomes the shortcomings of the prior art.

SUMMARY

In one embodiment the present disclosure relates to a tissue container free of a plastic film or paper dispensing window comprising a tissue dispensing portion on a top panel of the tissue container, the tissue dispensing portion comprising: (a) an outlet cut line having a wave shape form; (b) two opposite raised crease lines embossed on the top panel spaced on both left and right side of the outlet cut line, the two opposite raised crease lines being joined by curvilinear cut lines at each end of the two opposite raised crease lines; and (c) two outlet flaps, each outlet flap being defined between one of the two raised crease lines, the curvilinear cut lines and the outlet cut line, each of the two raised crease lines forming a smooth curve on an underside of the outlet flaps.

In one embodiment of the tissue container, each of the outlet flaps includes a raised fold line parallel to the raised crease line that protrudes above the surface of the top carton panel, each of the raised fold line being placed between the raised crease line land the outlet cut line, the raised fold line forming a smooth curve on the underside of the outlet panel.

In another embodiment of the tissue container, the tissue container further comprises a knockout section or piece formed at each end of the outlet cut line.

In another embodiment of the tissue container, the two opposite raised crease lines are joined by curvilinear cut lines at each end of the two opposite raised crease lines.

In another embodiment of the tissue container, the raised crease line is a straight crease line.

In another embodiment of the tissue container, the tissue dispensing portion is undercoated with a slip coating.

In another embodiment of the tissue container, the tissue dispensing portion is free of sharp corners.

In another embodiment of the tissue container of the present disclosure, each outlet flap to includes another raised fold line that protrudes above a surface of the top panel, each of the raised crease lines forming a smooth curve on an underside of each of the outlet flaps.

In another embodiment of the tissue container of the present disclosure, the tissue container is a single piece tissue container.

In another embodiment, the present disclosure provides for a carton blank of a tissue box comprising a series of panels foldably connected by transversely connected fold lines, the series of panels including a first side panel, a second side panel, a bottom panel and a top panel, wherein the top panel includes a tissue dispensing feature, the tissue dispensing feature comprising: (a) an outlet cut line having a wave shape form, (b) two opposite raised crease lines embossed on the top panel spaced on both left and right side of the outlet cut line; and (c) two outlet flaps, each outlet flap being defined between one of the two raised crease lines and the outlet cut line, each of the two raised crease lines forming a smooth curve on an underside of the outlet flaps.

In one embodiment of the carton blank, the bottom panel is foldably connected to the first side panel at a first transversely extending fold line, the top panel is foldably connected to the first side panel at a second transverse fold line, and the second side panel is foldably connected to the top panel at a third transverse fold line.

In another embodiment of the carton blank, the bottom panel and the top panel are foldably connected at each end to a first side end flap and the first side panel and the second side panel are foldably connected at each end to two side end flaps.

In another embodiment of the carton blank, the top panel further comprises a knockout section formed at each end of the outlet cut line.

In another embodiment of the carton blank, the two opposite raised crease lines are joined by curvilinear cut lines at each end of the two opposite raised crease lines.

In another embodiment of the carton blank, the raised crease line is a straight crease line.

In another embodiment of the carton blank, the tissue dispensing feature is coated on one side with a slip coating.

In another embodiment of the carton blank, the tissue dispensing feature is free of sharp corners.

In another embodiment of the carton blank of the present disclosure, each outlet flap includes another raised fold line that protrudes above a surface of the top panel, each of the two raised crease lines forming a smooth curve on an underside of each of the outlet flaps.

DETAILED DESCRIPTION

Figure 1:
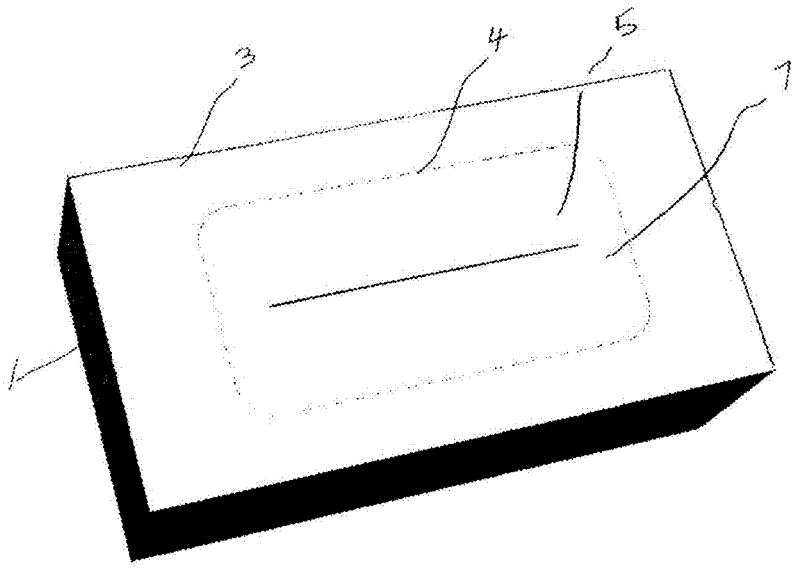
Fig. 1 (PRIOR ART)
FIG. 1 is a perspective view of a conventional tissue carton with a tear away top panel of the prior art.
Figure 2:
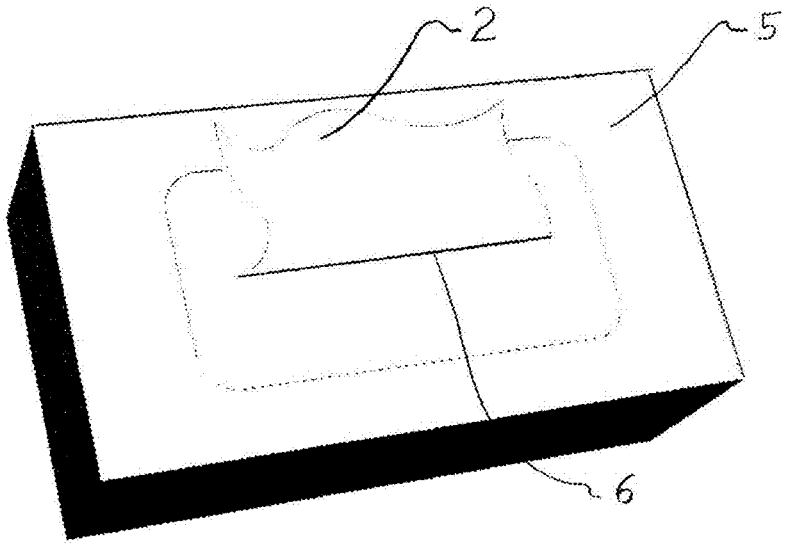
Fig. 2 (PRIOR ART)
FIG. 2 is a perspective view of a conventional tissue box of the prior art with the tear away panel removed, to expose an attached poly film dispensing panel.

In this specification and in the claims that follow, reference will be made to several terms that shall be defined to have the meanings below. All numerical designations, e.g., dimensions and weight, including ranges, are approximations that typically may be varied (+) or (−) by increments of 0.1, 1.0, or 10.0, as appropriate. All numerical designations may be understood as preceded by the term "about".

The term "about," particularly in reference to a given quantity, is meant to encompass deviations of plus or minus five percent.

Throughout this specification and the claims, the terms "comprise," "comprises," and "comprising" are used in a non-exclusive sense, except where the context requires otherwise. Likewise, the terms "include", "has" and their grammatical variants are intended to be non-limiting, such that recitation of items in a list is not to the exclusion of other like items that can be substituted or added to the listed items. "Consisting essentially of" when used to define a tissue box or a method, shall mean excluding other elements of any essential significance to the combination for the intended use. "Consisting of" shall mean excluding more than trace elements of other ingredients and substantial method steps for using the systems of the present disclosure. Embodiments defined by each of these transition terms are within the scope of this disclosure.

The present disclosure relates to a tissue box or container having an intrinsic opening and intrinsic tissue dispensing feature. The tissue box of the present disclosure is free of plastics or any other extrinsic features to help dispense tissues from the box.

With reference to FIGS. 4 to 10, a tissue container 111 of the present disclosure features an opening feature with left and right outlet panels 114, that part and separate to provide a wide opening 116, to access tissue pile or stack 119, then select and withdraw the first (top) tissue 110. The entire opening and tissue extraction process is carried out without the need to tear out any perforated panels or cut out sections of tissue carton 111. In one embodiment, the tissue container of the present disclosure is a single-use tissue box. In another embodiment, the tissue container of the present disclosure is a multiple-use tissue box. For example, a stack of tissue may be inserted through the wide opening 116.

Figure 3A:
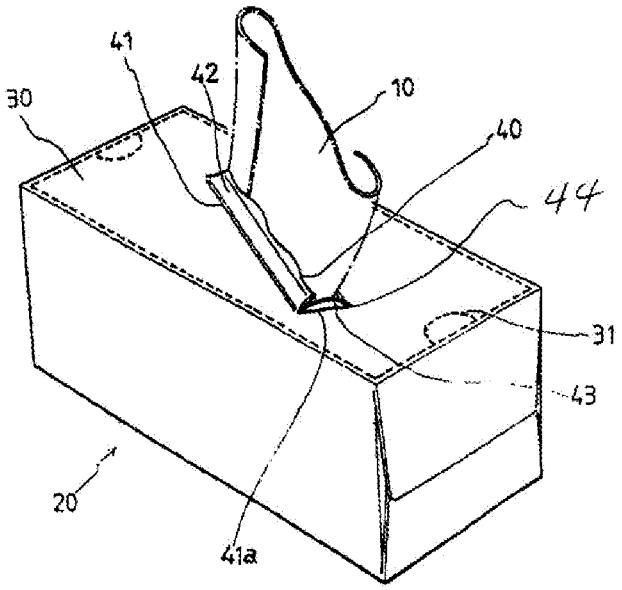
Fig. 3A (PRIOR ART)
FIG. 3A is a perspective view of a prior art tissue box (WO97/39964).
Figure 3B:
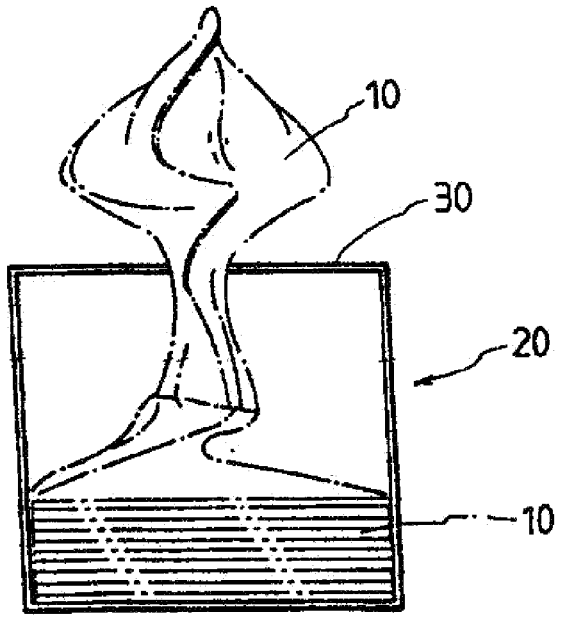
Fig. 3B (PRIOR ART)
FIG. 3B is an end view of a prior art tissue box (WO97/39964).

The fabrication and testing of tissue carton prior art FIG. 3A, WO1997039964 results indicated the narrow profile/design of the tissue outlet restricts access to the tissue stack, thereby compromising selection and extraction of the first tissue. The design of the tissue carton of the present disclosure provides for a wide opening and easy access and selection of the first tissue. Once the first tissue has been withdrawn from the tissue carton, the outlet flaps/panels spring back to separate, hold and support the following tissue.

Figure 4:
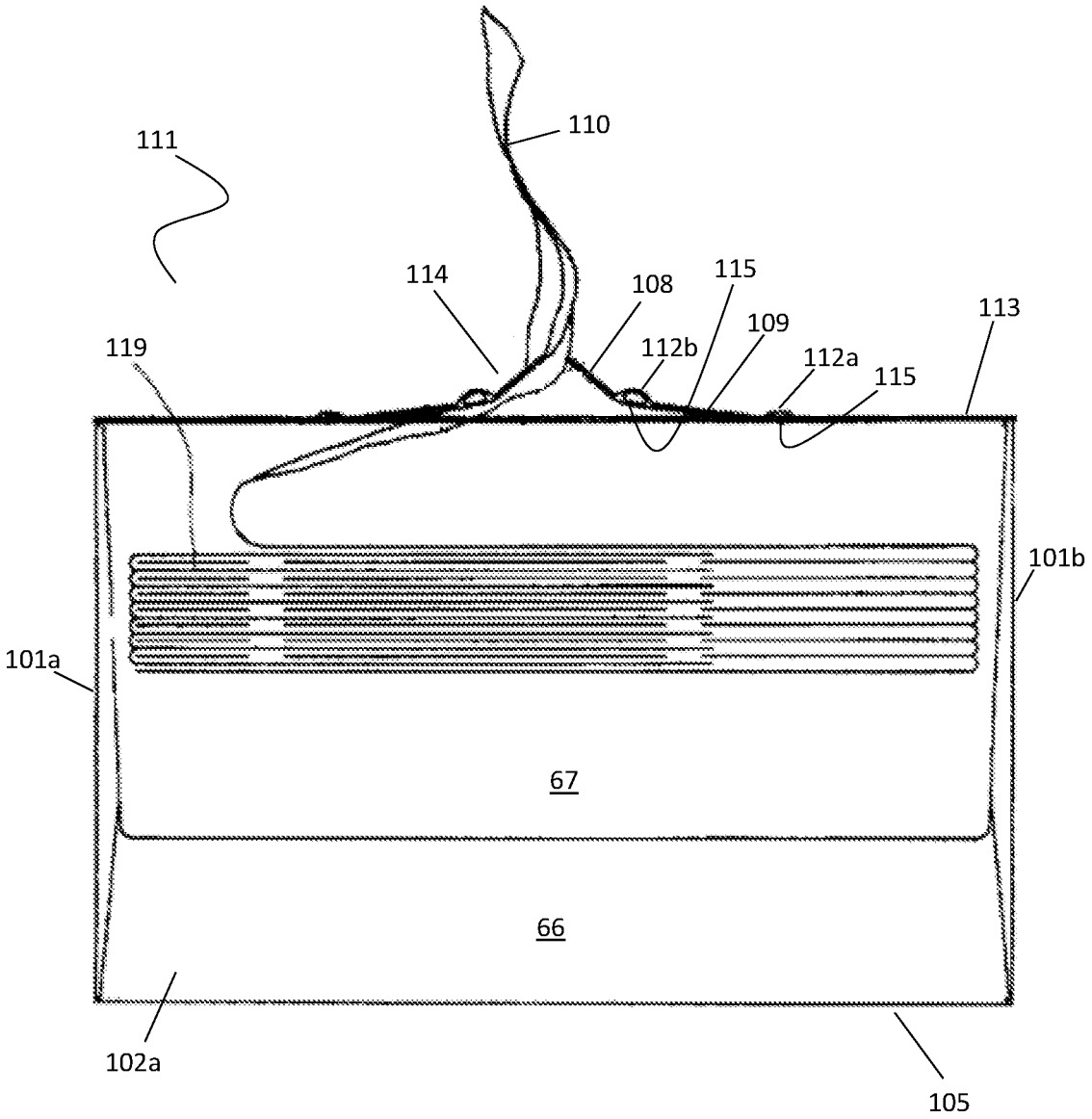
FIG. 4 is a view from one of the side ends of a tissue carton in accordance with one embodiment of the present disclosure. The figure is transparent, thus allowing to see the stack of tissue paper inside the tissue carton.
Figure 5:
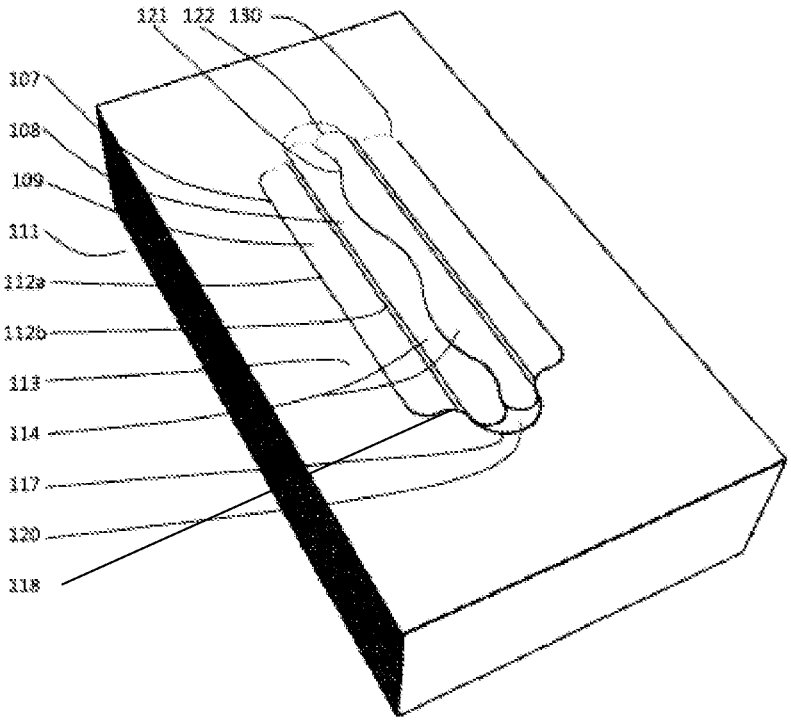
FIG. 5 is a perspective view of a tissue carton in accordance with one embodiment of the present disclosure.
Figure 6A:
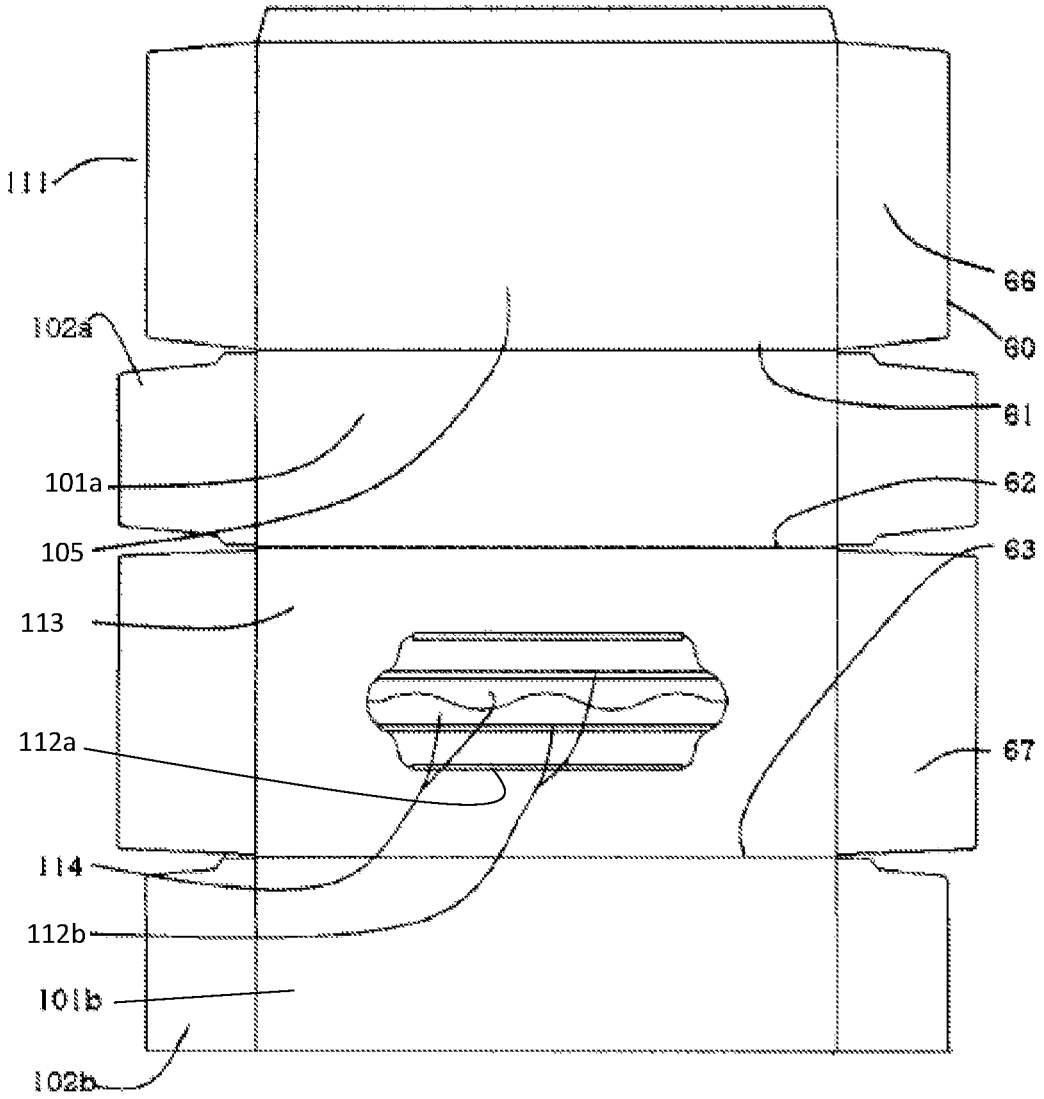
FIG. 6A is a view of the outside of an unfolded tissue carton in accordance with one embodiment of the present disclosure.
Figure 6B:
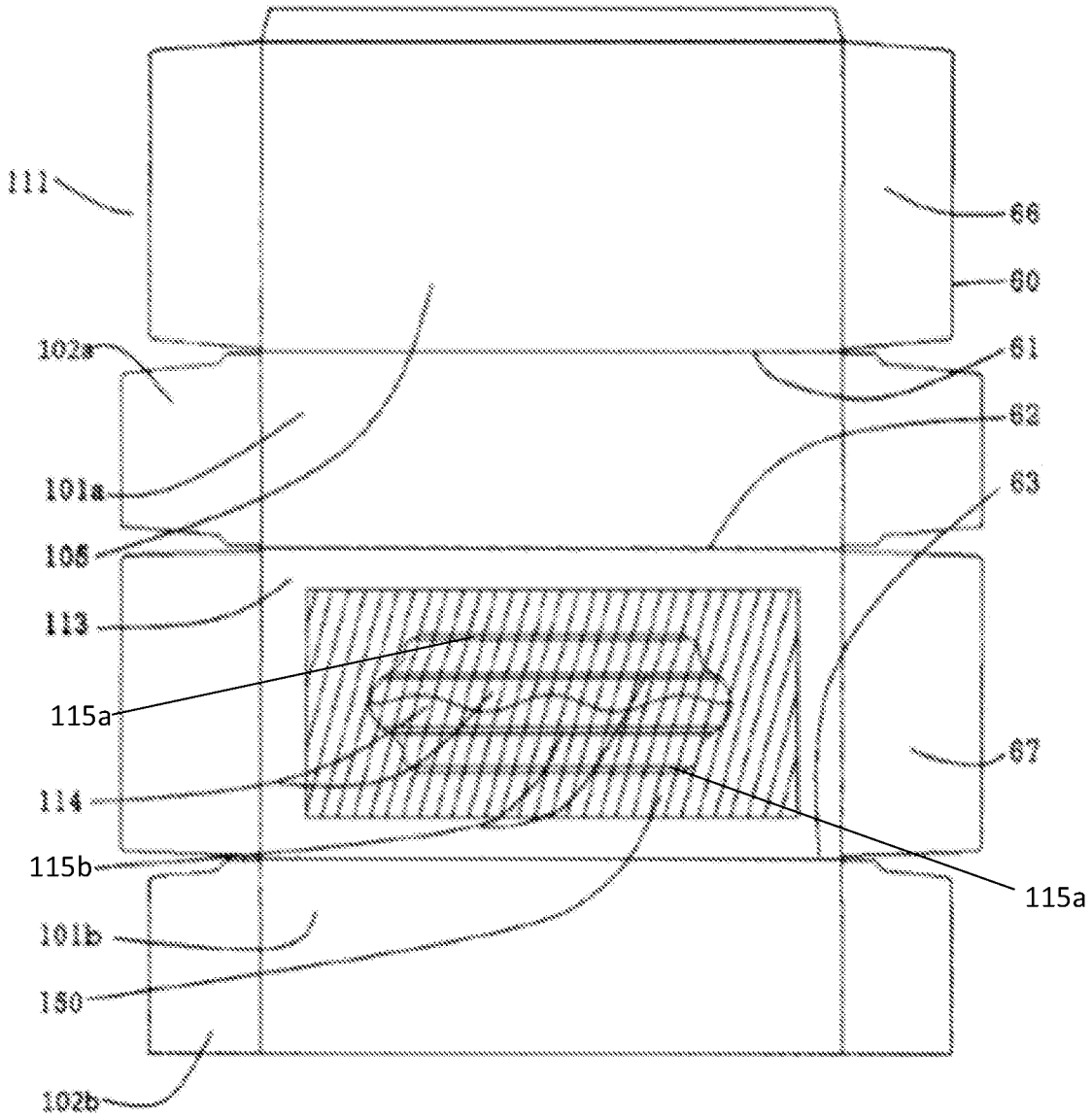
FIG. 6B is a view of the inside of an unfolded tissue carton in accordance with one embodiment of the present disclosure, showing a high slip coating on the underside or inside of the tissue carton top panel, prior to carton forming and sealing.
Figure 9:
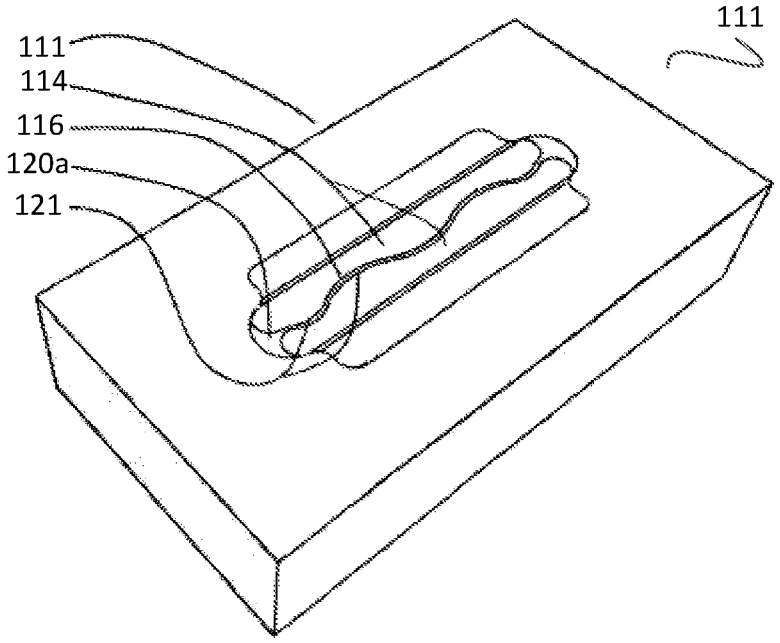
FIG. 9 is a perspective view of a tissue carton in accordance with one embodiment of the present disclosure, showing the opened tissue outlet with knock out portion removed.

With reference to FIGS. 4, 5 and 9, in one embodiment, disclosed herein is a tissue box or container 111 which comprises a top wall or panel 113, a bottom wall or panel 105 that is opposite to the top wall or panel 113, opposite first and second side panels 101*a* and 101*b*, first and second opposite side end walls 102*a* and 102*b*, and a tissue dispensing portion 107 disposed on the top wall or panel 113. The side walls 101*a,b*, side end walls 102*a,b*, bottom panel 105 and top panel 113 define an interior of the box 111 for containing a plurality of tissues 119. In one aspect, the container 111 is made out of a single-piece primary blank. One embodiment of a primary blank is shown in FIG. 6A (outside view of the blank) and 6B (inside view of the blank). In one embodiment, the first and second side end walls 102*a,b* are formed by the folding of side end flaps 66 and 67 as shown in FIGS. 6A-6B. In another aspect, the tissue dispensing portion 107 of the present disclosure is free of sharp, straight corners. In another aspect, the dispensing portion 107 of the present disclosure is free of perforated cut lines. A perforated line that holds two pieces together includes multiple perforations, or small holes. Once the two pieces are detached, each piece includes a serrated edge at the perforation line. The serrated edges thus created can damage facial tissues.

In its unopen form (FIG. 5) the dispensing portion 107 comprises an outlet cut line 121 having the form of a consistent wave shaped cut, and left and right outlet panels 114. In the embodiment shown in FIG. 5, the dispensing portion 107 also includes a knockout section 120 found at each end of the outlet panels 114.

The outlet cut line 121 runs along a long axis direction or along a short axis direction on the top wall 113, or along a diagonal direction. The figures show the outlet cut line 121 being cut along the long axis of container 111, however, it is understood that the outlet cut line 121 can be cut along the short axis of the container 111 or along a diagonal direction. At least two formed and raised/embossed crease lines 112*a* in the top panel 113 are strategically spaced on each of the left and right side of the outlet cut line 121 respectively with a certain distance about the outlet cut line 121. A combination of cut curved lines 130, 118, 122 extends from each end of the crease line 112*a* towards the outlet cut line 121.

Figure 8:
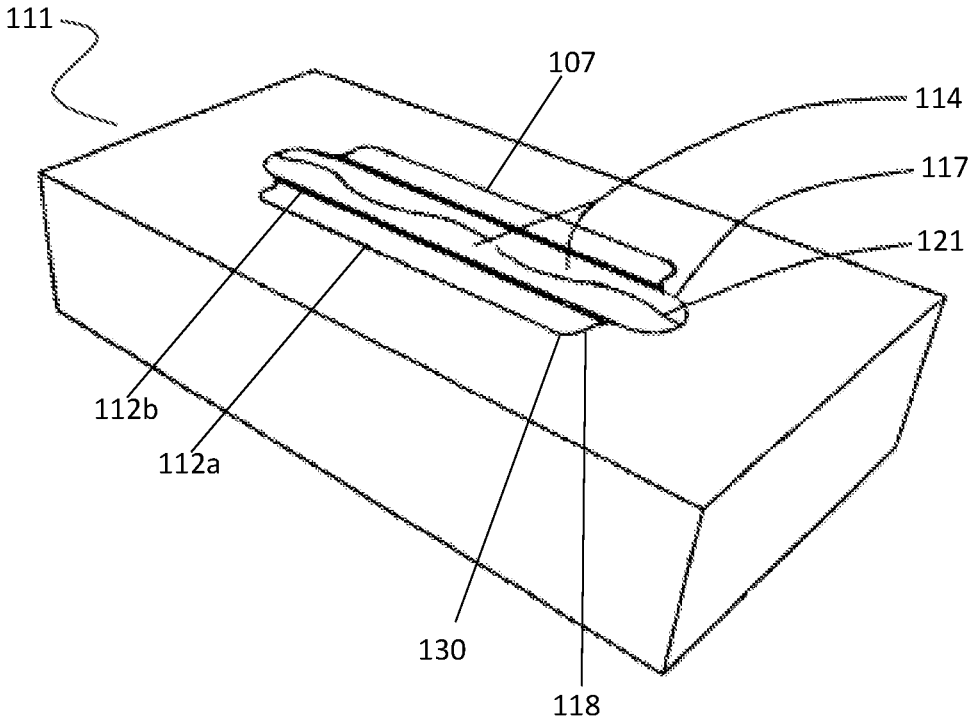
FIG. 8 is a perspective view of the tissue carton of FIG. 7 having an unopened tissue dispensing outlet, showing a curvilinear tissue outlet without a knockout portion.

Referring to FIGS. 5 and 8, in one embodiment, the wave cut 121 between left and right outlet panels 114 is a consistently pitched curvilinear cut line, that separates the left and right outlet panels 114.

The left and right outlet panels or flaps 114 are formed on each side of the outlet cut line 121. In the embodiment of FIG. 5, each of the left and right outlet panels 114 is defined by the outlet cut line 121, the raised crease lines 112*a* and the combination of cut lines 130, 118, 122 that form a curvilinear shape at each end of each of the tissue outlet panels 114. In the embodiment of FIG. 8, each of the left and right outlet panels 114 is defined by the outlet cut line 121, the raised crease lines 112*a* and the combination of cut lines 130, 118, 117 that form a curvilinear shape at each end of each of the tissue outlet panels 114.

The left and right outlet panels 114 have rounded corners 130, 122, located at each end of the respective panels 114. The rounded corners 130, 122 are joined by a line 118 that curves towards the outlet panels 114 (i.e., towards the middle portion of the box 111). The rounded corners 122 (FIG. 5) provide an inlet funnel for the moving surface of the interleafed tissues 110 (FIG. 4) to flow from the tissue stack 119 toward the centre of the outlet opening 116 (FIG. 9).

In one embodiment, each of the left and right outlet panels 114 include another raised fold line 112*b* that protrudes above the surface of the top carton panel. The raised/embossed crease lines 112*b* run parallel to the crease lines 112*a*. The inner crease lines 112*b* subdivide each of the outlet panels 114 into two portions: an inner portion 108 and an outer portion 109. Inner portion 108 is mostly defined by the outlet cut line 121 and the fold line 112*b*. The outer portion 109 is mostly defined by the inner fold line 112*b* and the outer crease line 112*a*. Outlet opening 116 is an intrinsic tissue dispensing opening in the sense that no extrinsic items, such as a sheet of plastic or paper is needed to dispense one tissue 110 at a time from the stack of tissues 119 inside box 111.

To open the tissue dispensing portion 107, the outlet cut line 121 is pressed down (i.e., towards the bottom wall 105) and the outlet leaves or flaps 114 are folded upward at the fold lines 112*a* and an opening 116 is formed at the site of the outlet cut line 121 (FIGS. 4 and 9). When the flaps 114 are folded upward at the fold lines 112*a*, the raised/embossed crease lines 112*a* form a smooth radius or curve 115*a* on the underside of the access panels 114, as opposed to prior art WO97/39964 which utilizes a depressed engraving line that forms a sharp bend when folded upward, thereby creating an obstruction and resistance to outgoing tissues moving through the dispensing outlet 16. Likewise, when the inner portion 108 is folded upward at raised fold line 112*b* the raised/embossed crease lines 112*b* form a smooth radius or curve 115*b* on the underside of the access panels 114.

In the embodiments shown in FIG. 5, the knockout or waste section 120 is an end piece that, in one embodiment, takes the form of an umbrella shaped piece or portion that is formed at each end of outlet 121. End piece 120 is defined by a curvilinear cut line 117 that extends from the cut line 118 and forms the top of what would be the umbrella's canopy, and the previously described curvilinear cut line 122 that forms what would be the perimeter of the canopy (FIG. 5). End piece 120 can be removed from the top carton panel 113 of tissue box 111 thereby leaving an opening 120*a*.

FIGS. 4 and 5 show outlet cut line 121 having the form of a consistent wave shaped cut, running in a longitudinal direction on the top carton panel 113 with a certain length and located about in the middle portion of the top carton panel 113.

The two raised fold lines 112*a* (FIG. 4) are embossed from the inside or underside of the left and right outlet panels 114 and protrude above the surface of the top carton panel 113. The embossed fold lines 112*a* run along the length of outlet panels 114.

With reference to FIG. 4, the under surface of the angled left and right tissue support outlet panels 114 apply lateral pinching pressure to each side of lead tissue 110. The tissue pinch pressure is controlled by the combined spring back force of the embossed creases 112*b*, and the length of the embossed bend or fold lines 112*b*, running longitudinally across outlet panels 114, which apply sufficient uniform pressure on each side of the interleafed tissues 110, to facilitate the passing of the tissues completely in between the outlet panels 114. Sufficient pressure is also applied to separate the interleafed tissues 110 from one another, when the lead tissue 110 exits the outlet panels 114. The remaining tissue is arrested from any further vertical movement and it is held in an erect vertical position by the lateral pinching pressure exerted by the right and left outlet panels 114. In this process, the following tissue from stack 119 is evenly drawn between outlet panels 114 into a fluted shape, which subsequently provides sufficient strength to support erect static standing of the following tissue 110.

In accordance with one embodiment of the present disclosure there is provided a tissue carton 111 without perforated waste or tear out portions or panels used to access the first tissue. The embodiment of FIGS. 5 and 9 includes a full cut umbrella shaped, waste knock-out 120, located at each end of the tissue dispensing outlet. When depressed with a finger, the umbrella shape cut outs, drop down and provide an opening 120*a* having a concave rounded shape 117 at each end of the tissue outlet opening 116. This knock-out end piece 120 is not used to access the first tissue, instead the concave shape of knock-out end piece 120 provides a smooth corner free opening 120*a*, for the outside edges of the outgoing tissue to funnel through, without being wedged into a corner or catching on the rough edge left by perforation tears. The embodiments of FIGS. 7-8 and 10 do not include a tear-out panel or a knock-out portions.

Prior art WO97/39964 utilizes a perforated convex curve, which projects into each end of the tissue outlet subsequently directing out moving tissues toward sharp corners 44 (FIG. 3A), which intermittently results in some tissues wedging and tearing during the extraction process.

Access to the internal tissue stack is facilitated by depressing the center of the common cut line 121 (FIG. 5) between the outlet panels 114, which is temporarily held together by small uncut portions of the cut line, which are less than about 0.5 mm in width. These uncut areas are referred to as nicks or ties, which are strategically spaced along the perimeter of the cut wave line 121, to prevent opening or separation of the outlet panels during shipping and handling. The number of equally spaced nicks ranges from one to ten. A further option is the use of micro cuts spaced not more than about 0.5 mm apart, equally spaced along common wave line 121.

In accordance with one aspect of the present disclosure, there is provided a tissue carton comprising a common cut line 121 (FIG. 5) between the tissue outlet panels 114, consisting of a symmetrically pitched shape, to facilitate even distribution of a tissue along the entire length of the outlet opening 116 (FIG. 9). Prior art patent WO97/39964 utilizes an irregular wave design 40 (FIG. 3A) that results in inconsistent forming of the tissue and compromises vertical support of static free-standing tissues.

Figure 7:
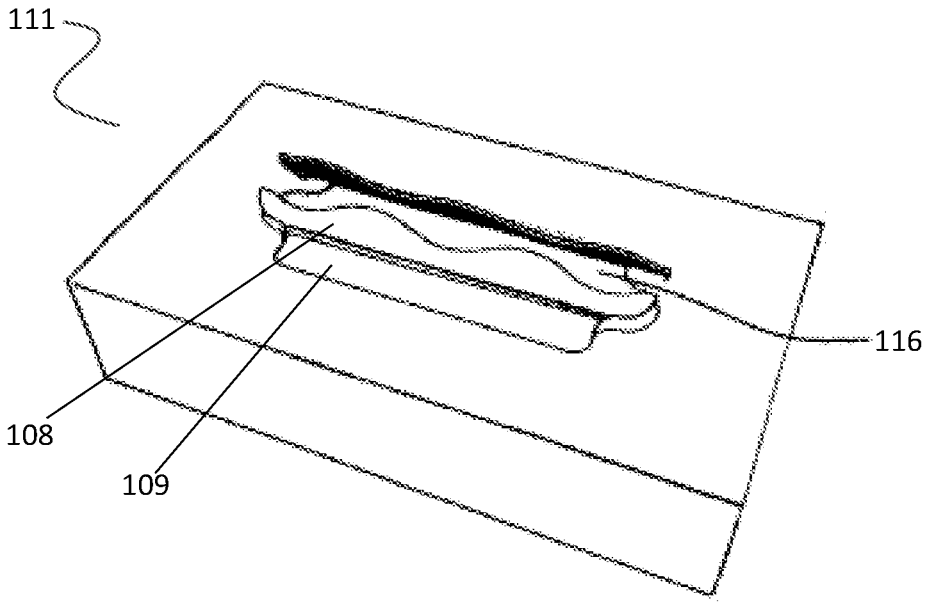
FIG. 7 is a perspective view of a tissue carton having an open tissue dispensing outlet in accordance with one embodiment of the present disclosure, showing a version of a dispensing feature design, without or free of any tear away access panels or portions.

The curvilinear shape produced by the cutlines 117, 118, 122 is designed to direct interleafed tissues from the ends of the tissue stack 119 (FIG. 4), to funnel and flow through opening 120 and flow onward, to distribute along and toward the middle of the outlet opening 116 (FIG. 7). The tissues travel from stack 119 through outlet 116 without incurring pre-separation or tearing of the tissues. Outlet panels 114 in combination with pressure applied by the raised embossed creases 112 apply sufficient resistance to trigger release of the lead tissue from the following tissue, upon exit from the left and right outlet panels.

FIG. 4 is a view of the tissue outlet panels 114 folded up and outward from one another, to form and adjust the tissue outlet space 116, and if desired, adjust the pinch pressure between outlet panels to control separation and static pressure on subsequent outgoing and static tissues.

The left and right outlet panels 114 have rounded corners 122, located at each end of the respective panels. The rounded corners 122 provide an inlet funnel for the moving surface of the interleafed tissues 110 to flow from the tissue stack 119 toward the centre of the outlet opening 116.

Referring to FIGS. 6A and 6B, in one embodiment, a primary blank 60 of tissue box 111 comprises a bottom panel 105 foldably connected to a first side panel 101*a* at a first longitudinal (from side end to side end) extending fold line 61, a top panel 113 foldably connected to the first side panel 101*a* at a second longitudinal fold line 62, and a second side panel 101*b* foldably connected to the top panel 113 at a third longitudinal fold line 63. The bottom panel 105 and the top panel 113 are foldably connected at each end to a first side end flap 66. The first side panel 101*a* and the second side panel 101*b* are foldably connected at each end to two side end flaps 67.

With reference to FIG. 6B, the underside (lining of the box's 111 interior) of the top carton panel 113 includes a high slip coating 150 lithographed on its surface. The coating could be an aqueous coating or varnish (for example aqueous coatings of Nova Aqueous Coating). The coating 150 (FIG. 6B) is indicated on the underside view of an unfolded die-cut carton. The high slip coating 150 serves to reduce friction between the outgoing tissues 110 (FIG. 4), the curved underside 115*a,b* of the embossed creases 112*a,b* and the underside of the outlet dispensing panels 114.

Figure 10:
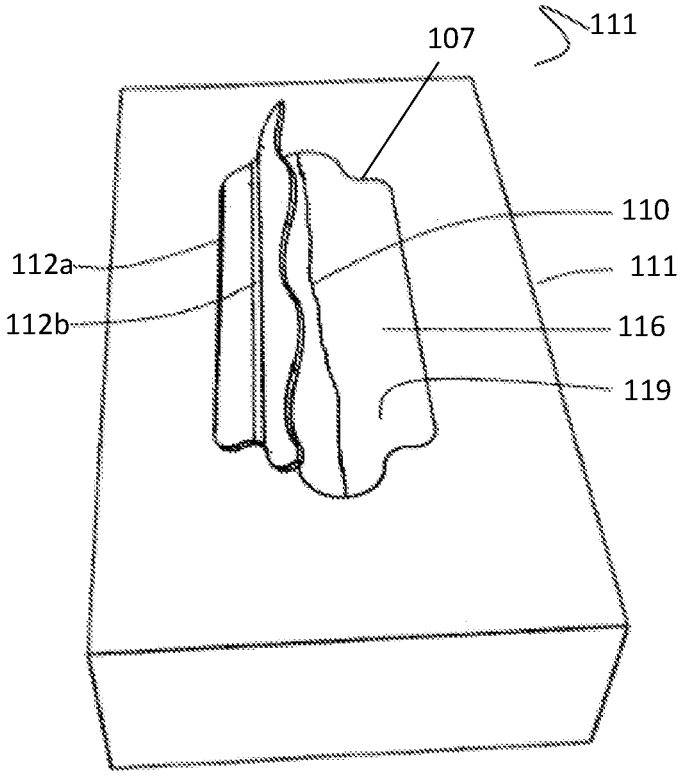
FIG. 10 is a top perspective view from the end side of a tissue carton in accordance with one embodiment of the present disclosure.

FIGS. 7, 8 and 10 illustrate an embodiment of a tissue carton 111 dispensing feature 107 without any tear or knockout panels required to access the lead/first tissue on tissue stack. FIGS. 7, 8 and 10 refer to one embodiment of the present disclosure without the knockout portion 120 shown in FIGS. 4, 5 and 9. This embodiment eliminates the removal of tear away perforated sections, thereby creating a tissue carton 111 without any tear away or knock out sections.

FIG. 8 is a view of tissue carton 111 with a cut line 121 fully extended between the outlet cuts 117, running through the entire length of the outlet opening. This embodiment eliminates the use of a tear or knock out opening panel, thereby providing as shown in FIGS. 7-8 and 10, one step access to the internal tissue stack, by depressing the center of the common cut line 124 shown in FIG. 8 and folding back the outlet panels 114 as shown in FIGS. 7 and 10 to access tissue stack.

Through the embodiments that are illustrated and described, the currently contemplated best mode of making and using the disclosure is described. Without further elaboration, it is believed that one of ordinary skill in the art can, based on the description presented herein, utilize the present disclosure to the full extent. All publications cited herein are incorporated by reference.

Although the description above contains many specificities, these should not be construed as limiting the scope of the disclosure, but as merely providing illustrations of some of the presently embodiments of this disclosure.

What is claimed:

1. A tissue container free of a plastic film or paper dispensing window comprising an interior for containing a plurality of tissues and a tissue dispensing portion on a top panel of the tissue container, the top panel having an underside surface facing the interior of the tissue container and an outside surface facing opposite to the underside surface, the tissue dispensing portion comprising:

(a) an outlet cut line having a wave shape form;

(b) two raised creases on the top panel that protrude above the outside surface of the top panel and being spaced on each side of the outlet cut line, the two raised creases being joined by curvilinear cut lines at each end of the two raised creases; and (c) two outlet flaps, each outlet flap being defined between one of the two raised creases, the curvilinear cut lines and the outlet cut line, wherein each outlet flap includes another raised crease that protrudes above the outside surface of the top panel, the raised crease of each outlet flap forming a smooth curve on the underside surface of each of the outlet flaps.

2. The tissue container of claim 1, wherein each of the two raised creases on the top panel forms a smooth curve on the underside surface of the outlet flaps when each of the two outlet flaps is folded upward at the two creases.

3. The tissue container of claim 1, wherein the tissue container further comprises a knockout piece formed at each end of the outlet cut line.

4. The tissue container of claim 1, wherein each of the two raised creases on the top panel is a straight crease.

5. The tissue container of claim 1, wherein the tissue dispensing portion is undercoated with a slip coating.

6. The tissue container of claim 1, wherein the tissue dispensing portion is free of sharp corners.

7. The tissue container of claim 1, wherein the tissue container is a single piece tissue container.

8. A single-piece carton blank of a tissue box comprising a series of panels foldably connected by transversely connected fold lines, the series of panels including a first side panel, a second side panel, a bottom panel and a top panel, wherein the top panel includes a tissue dispensing feature, the top panel having an underside surface facing an interior of the tissue box when the carton blank is folded into the tissue box and an outside surface facing away from the interior of the tissue box, the tissue dispensing feature comprising: (a) an outlet cut line having a wave shape form, (b) two raised creases on the top panel that protrude above the outside surface of the top panel and being spaced on each side of the outlet cut line; and (c) two outlet flaps, each outlet flap being defined between one of the two raised creases and the outlet cut line, each of the two raised creases forming a smooth curve on an underside of the outlet flaps, wherein each outlet flap includes another raised crease that protrudes above the outside surface of the top panel, the raised crease of each outlet flap forming a smooth curve on the underside surface of each of the outlet flaps.

9. The carton blank of claim 8, wherein the bottom panel is foldably connected to the first side panel at a first transversely extending fold line, the top panel is foldably connected to the first side panel at a second transverse fold line, and the second side panel is foldably connected to the top panel at a third transverse fold line.

10. The carton blank of claim 8, wherein the bottom panel and the top panel are foldably connected at each end to a first side end flap and the first side panel and the second side panel are foldably connected at each end to two side end flaps.

11. The carton blank of claim 8, wherein the top panel further comprises a knockout section formed at each end of the outlet cut line.

12. The carton blank of claim 8, wherein the two raised creases are joined by curvilinear cut lines at each end of the two raised creases.

13. The carton blank of claim 8, wherein each of the two raised creases on the top panel is a straight crease line.

14. The carton blank of claim 8, wherein the underside surface of the tissue dispensing feature is coated on one side with a slip coating.

15. The carton blank of claim 8, wherein the tissue dispensing feature is free of sharp corners.

* * * * *